United States Patent [19]

Dubbelman et al.

[11] Patent Number: 4,938,273

[45] Date of Patent: Jul. 3, 1990

[54] VERTICALLY MOVABLE DOOR STRUCTURE

[76] Inventors: Voldemar Dubbelman; Stefan Dubbelman, both of Björkliden 16, S-703 58 Örebro, Sweden

[21] Appl. No.: 346,981

[22] PCT Filed: Oct. 19, 1987

[86] PCT No.: PCT/SE87/00480

§ 371 Date: Apr. 7, 1989

§ 102(e) Date: Apr. 7, 1989

[87] PCT Pub. No.: WO88/03217

PCT Pub. Date: May 5, 1988

[30] Foreign Application Priority Data

Oct. 24, 1986 [SE] Sweden ..... 8604558

[51] Int. Cl.[5] ..... E05D 15/00

[52] U.S. Cl. ..... 160/201; 160/84.1

[58] Field of Search ..... 160/201, 84.1, 202, 160/32, 33

[56] References Cited

U.S. PATENT DOCUMENTS

| | | | |
|---|---|---|---|
| 2,409,037 | 10/1946 | Guth | 160/33 |
| 3,313,338 | 4/1967 | Knight | 160/202 X |
| 3,926,242 | 12/1975 | Lowe | 160/84.1 X |
| 4,194,549 | 3/1980 | Lovgren | 160/84.1 |
| 4,368,770 | 1/1983 | Ulfhielm | 160/84.1 |
| 4,397,347 | 8/1983 | Brabant | 160/84.1 X |
| 4,524,814 | 6/1985 | Deziel | 160/84.1 X |
| 4,725,000 | 2/1988 | Deziel | 160/84.1 X |

*Primary Examiner*—David M. Purol

*Attorney, Agent, or Firm*—Sughrue, Mion, Zinn, Macpeak & Seas

[57] ABSTRACT

A vertically foldable door or barrier structure including a door leaf which is divided into a multiple of horizontal, mutually foldable panels or sections and which is guided in side guides arranged on the sides of the door opening. For the purpose of obtaining positive folding of the door leaf when raising the door leaf and to enable the door leaf to be made completely of a flexible fabric material, at least the end portions of each alternate panel are made of rigid or are attached to rigid strips or the like, whereas remaining panels are fully flexible. The rigid end portions of each alternate panel are therewith connected with guide elements which co-act guidingly with an associated pair of side guides. The number of side guides on each side shall thus equal the number of panels having rigid end portions.

10 Claims, 4 Drawing Sheets

VERTICALLY MOVABLE DOOR STRUCTURE

BACKGROUND OF THE INVENTION

The present invention relates to a vertically moving door or barrier structure comprising a door leaf which is divided into a plurality of mutually hinged leaf panels and which is guided for movement in guide arrangements located on each side of the door opening.

The need for doors which are able to function vertically is found in many different connections, such as in storage locations and industrial buildings for example. This need becomes apparent, inter alia, when the space on one or both sides of a door opening is very restricted.

One requirement placed on door structures of this kind is that they occupy the smallest space possible in their raised position. One such known door structure is described in Swedish Patent Specification No. 376 041, this known structure comprising a multiple of fabric panels or sections which have arranged therebetween rigid cross-struts which are guided in the side edges of the door opening. When opening this door, by winching up the lower cross-strut, the door panels or sections are intended to fold symmetrically about the struts. Folding of the panels, however, is not positively controlled in this door arrangement, and consequently a larger part of the fabric material is liable to fold up on one side of the door than on the other side, e.g. due to the force of the wind or due to similar influences, which causes the door in its raised position to take up more space than intended. Furthermore, the door becomes unsightly in its upper raised position, if not folded properly.

Because of the rigid cross-struts, the known door structure is also relatively heavy and accidents or injury may occur should the door inadvertently drop down in the door opening. Because the door structure is a hazard in this regard, it is necessary to provide the door structure with conventional means for protecting persons or objects positioned beneath the door

SUMMARY OF THE INVENTION

The main object of the present invention is to provide an improved door structure of the aforesaid kind which can be made much lighter than known door structures and, if so desired, can be made entirely from inexpensive fabric material without needing to provide transverse stiffening parts, therewith obviating the need for the aforesaid protective means. The light weight of the door also enables it to be raised quickly. The door structure shall also be capable of taking up large differencies between inside and outside pressures, shall be capable of being manufactured inexpensively and capable of being transported and installed at low costs, and when raised shall be guided in a manner such that respective door panels or sections are folded positively, so as to always occupy the same amount of space in the door-raised position and therewith form an aesthetic package.

The door structure according to the invention is mainly characterized in that at least the end edges of each alternate panel are rigid or attached to rigid strips or corresponding devices; in that at least remaining panels are made of a flexible fabric or corresponding material; in that the rigid end portions of each alternate panel are connected to guide means which co-act with an associated pair of side guides; and in that the number of side guide pairs corresponds to the number of rigid side-edge portions.

Since the totally flexible panels are always located between two panels which are provided with rigid end portions, the door leaf of a door or barrier constructed in accordance with the invention will always be folded in a positive manner as the door is raised.

The door leaf is preferably provided with an even number of panels, the lowermost panel being provided with rigid end portions and guided in a respective pair of side guides, whereas the uppermost panel is flexible and attached along its long edge to the upper horizontal defining edge of the door opening, wherewith means for raising the door or barrier are attached to the rigid end portions of the lower panel. Each panel provided with rigid end portions preferably has at least the same width or breadth as the intermediate flexible panels and is conveniently provided with two pairs of guide means for co-action with the pairs of side guides associated with respective panels.

In accordance with a preferred embodiment, all panels are made of flexible fabric and the guide means and side guides are constructed so as to mutually co-act in a manner to take up tension forces that occur in the surface of the door leaf, inter alia, due to wind forces. The guide means may include suitable rollers or wheels which rotate about axes perpendicular to the plane of the fabric panels and which co-act with vertical guide surfaces on said side guides, these guide surfaces being located between the rollers and the fabric panels.

The door structure may also be constructed with each alternate panel being totally rigid or contained in a rigid frame, the characteristic features of such a door structure, and other features characteristic of the invention, being set forth in the following claims.

BRIEF DESCRIPTION OF THE DRAWINGS

The invention will now be described in more detail with reference to exemplifying embodiments thereof illustrated in the accompanying drawings, in which.

DESCRIPTION OF THE PREFERRED EMBODIMENTS

Figure 1:
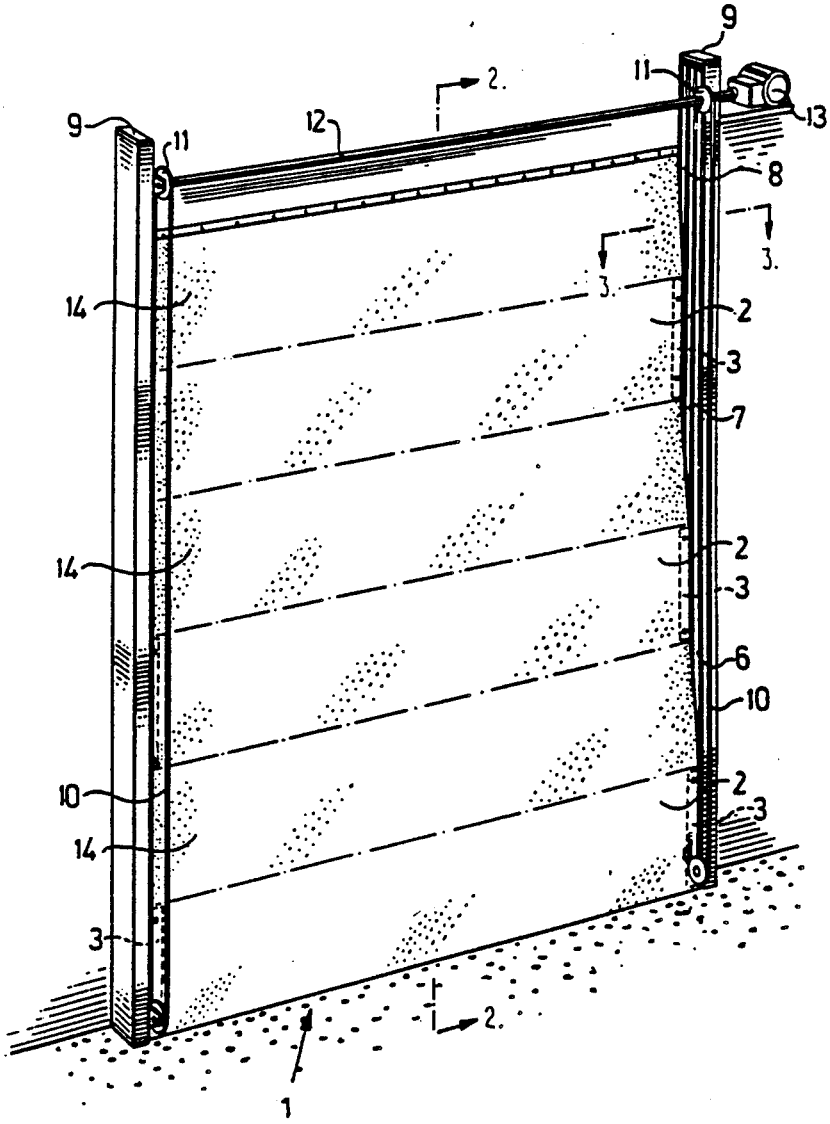
FIG. 1 illustrates a first embodiment of a door or barrier structure according to the invention.

The door structure illustrated in FIG. 1 is constructed for vertical movement, i.e. the door leaf 1 can move solely vertically. The door surface or plane can be considered to be divided into a multiple of horizontal panels or sections capable of being folded relative to one another along the illustrative chain lines, although there need be no physical border line or separation between the various panels. Thus, the entire door leaf may comprise a single, continuous piece of fabric, e.g. PVC-coated nylon or polyester-reinforced fabric.

The door leaf 1 of the FIG. 1 embodiment comprises one single fabric piece in which the ends of each alternate panel or section 2, beginning from the lowermost panel, are stiffened with the aid of rigid strips 3 securely fastened to respective fabric panels. Each of the strips 3 is provided with an upper and a lower roller or wheel which runs in a channel 6,7 and 8 intended for each of the illustrated panels 2 having stiffened end portions. The reference 10 in FIG. 1 designates hoisting or winching means in the form of cords, chains, toothed belts or corresponding devices, which are attached to the lower panel 2 provided with stiffened or rigid end portions 3, such as to raise the door leaf upon rotation of an upper shaft 12, said shaft having two pulleys 11 mounted thereon and being driven by a motor 13. The hoisting mechanism may take any desired form, and may also be hand-operated with the aid of a cranking handle or some like device. The door leaf is preferably lowerable under the action of its own weight, which prevents damage due to clamping or squeezing and which, because the illustrated door leaf comprises solely soft fabric material and is also very light, obviates the need for a crush guard along the lower downwardly facing edge of the door leaf, in view of the fact that the force exerted by the door leaf as it falls presents no serious hazard to persons or objects positioned therebeneath.

Figure 2C:
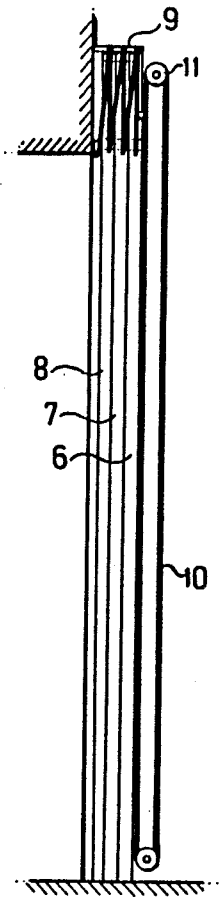
FIGS. 2A, 2B and 2C are cross-sectional views of the door structure illustrated in FIG. 1, taken on the line II—II in said Figure during closed, partly open and fully open positions, respectively.
Figure 2B:
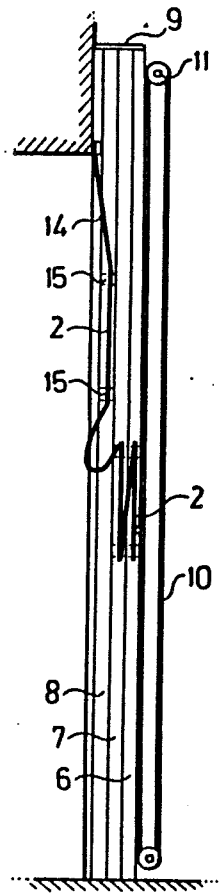
Figure 2A:
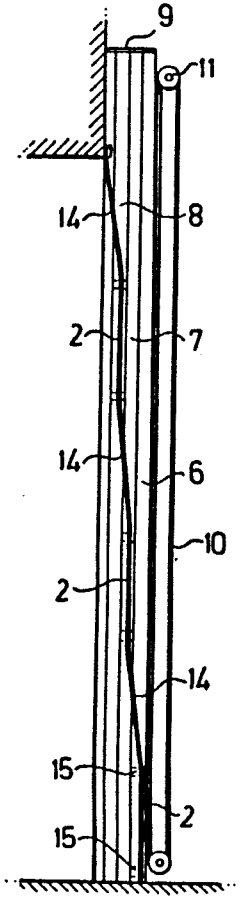

FIG. 2A is a vertical section of the door taken along the line II—II in FIG. 1, and shows the door in its closed position. The Figure shows that each of the panels 2 having stiffened end parts run in corresponding channels 6,7 and 8 respectively in the rail 9. The stiffened panels 2 are held together by the intermediate, fully flexible fabric panels or sections 14. The reference numeral 15 identifies the guide rollers attached to each of the stiffened panels 2 and running in channels 6–8.

FIG. 2B illustrates the door leaf in a partially raised position. This position is reached by pulling the cord 10, which when drawn in the door-raising direction causes the lower, stiffened panel 2 to move upwards and to entrain the overlying flexible section 14, which is consequently folded in between the lower stiffened panel 2 and the following stiffened panel 2, this latter then being entrained in said upper movement by the intermediate flexible panel 14.

The remaining panels are folded in a similar manner, until the door leaf is fully raised with all panels folded in relation to one another to form a regular package, as seen in FIG. 2C. As a result of this construction of the described door leaf, the various panels will always be folded positively in the same manner, relative to one another, to form an aesthetic package.

The panels or sections of the illustrated door leaf all have essentially the same width or breadth, which is to be preferred. However, irrespective of whether the panels all have the same width or not, the breadth of the stiffened panels 2 should not be smaller than the breadth of intermediate, fully flexible panels 14.

Figure 3:
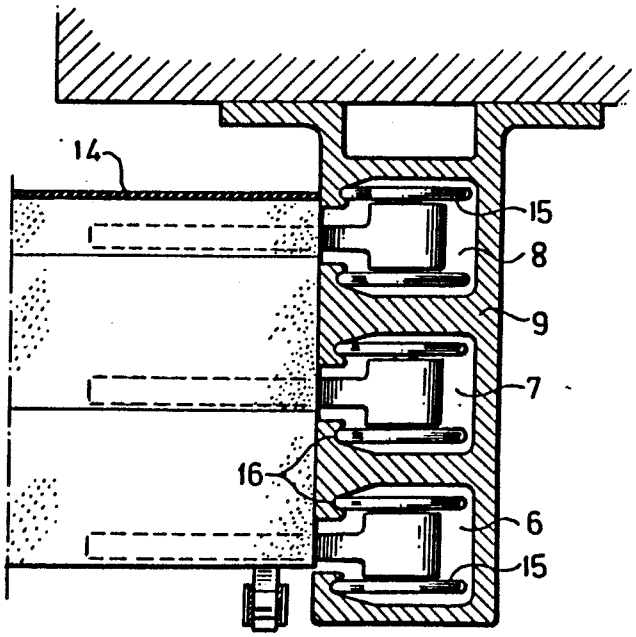
FIG. 3 is a part sectional view of the door structure illustrated in FIG. 1, taken on the line III—III in said Figure.

FIG. 3 is a sectional view taken on the line III—III in FIG. 1 and illustrates how the panels 2 with stiffened end parts 3 are guided in the rail 9 with the aid of rollers or wheels 15 which are rotatable about axes extending perpendicularly to the door leaf 1 and co-acting with vertical guide surfaces 16 on the channels 6–8 in the rail 9. The illustrated method of attaching and guiding the leaf panels enables the door to withstand high pressure differentials between the inner and outer sides of the door, since wind forces or the like acting on the door leaf act in the manner of tension forces directed in the plane of the panels, these tension forces being taken up by the rollers 15 and the co-acting guide surfaces 16.

Since each alternate panel 2 is precisely fixated and extends across the door opening, the door leaf is also able to abut the rails 9 very tightly along the sides of the door opening. Because of the method of their attachment, each of the guided panels 2, when using a substantially non-stretchable fabric material, will function as an essentially totally rigid panel, such as to enable the door leaf to be raised, e.g., by lifting the lowermost panel solely from one side of the door leaf. This facility is thus afforded in the absence of any form of stiffening cross-strut or like device whatsoever.

Figure 4:
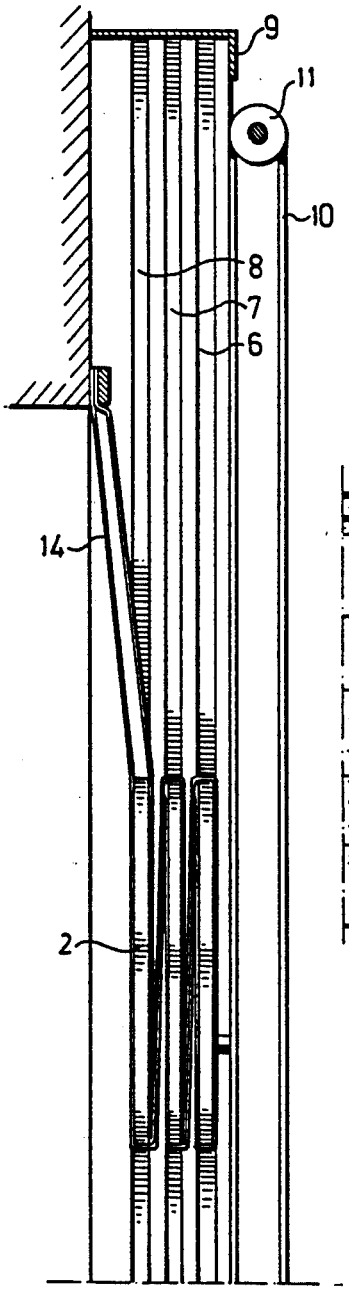
FIG. 4 is a part schematic sectional view of a second embodiment of a door structure according to the invention.

FIG. 4 illustrates an embodiment of the invention in which the door leaf comprises two fabric pieces with an air space therebetween, the door leaf of the preceding embodiments comprising but a single piece of fabric. The components of the FIG. 4 embodiment which correspond to similar components of the embodiments previously described have been identified with the same reference numerals.

Figure 5:
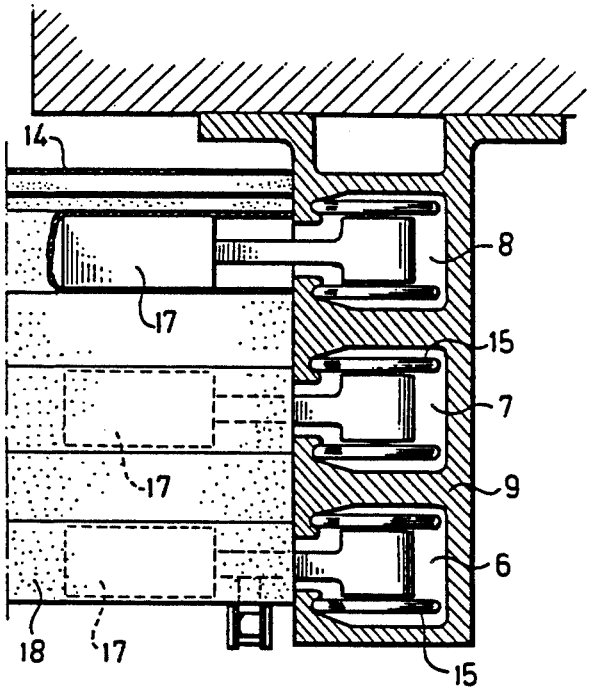
FIG. 5 is a sectional side view of a door structure according to FIG. 4.

FIG. 5 is a sectional view corresponding to FIG. 3, but illustrating the door leaf of the FIG. 4 embodiment. In this Figure the rigid strips provided at the ends of each alternate panel 2 are referenced 17 and can be used as spacer elements between the two fabric layers of respective panels to form the intermediate air space 18.

Figure 6:
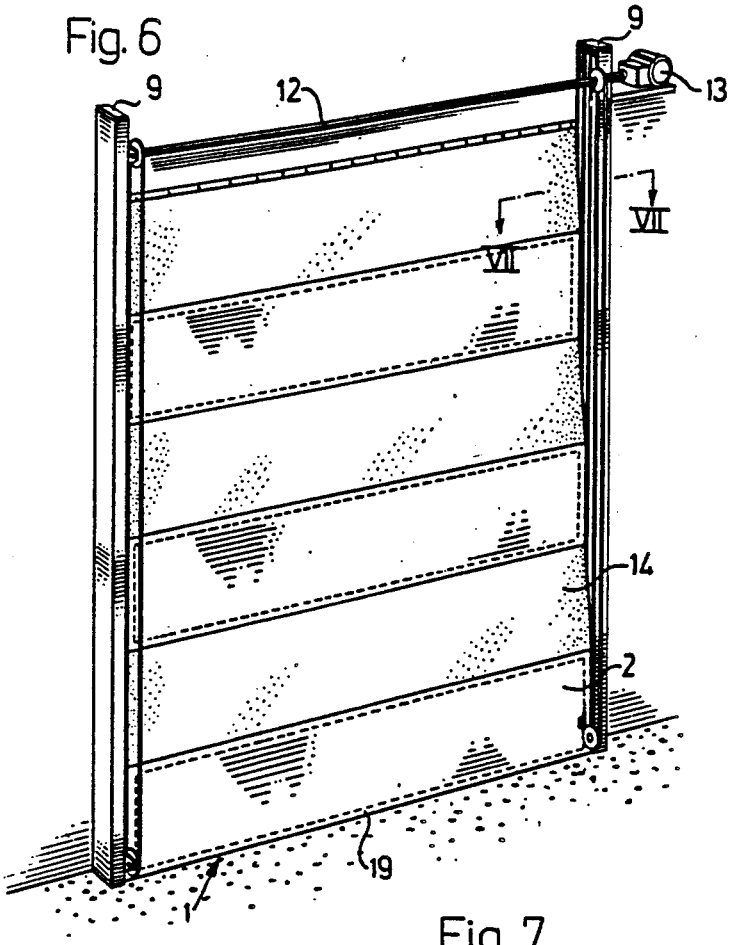
FIG. 6 is a schematic perspective view of a third embodiment of a door structure according to the invention.

FIG. 6 is a perspective view corresponding to FIG. 1 of a further embodiment of a vertically movable door structure according to the invention. The difference between this embodiment and those previously described is that each alternate panel 2 of the door leaf of the FIG. 6 embodiment is made totally rigid, in some way or another, e.g. made of a rigid material and/or encased in a surrounding rigid frame 19, as illustrated in broken lines.

Figure 7:
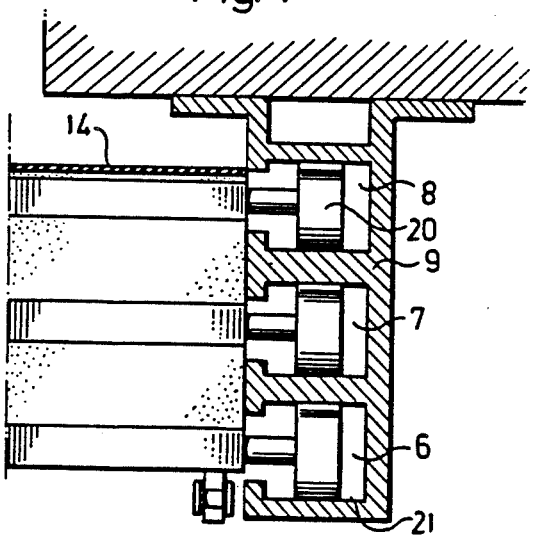
FIG. 7 is a part sectional view of the door structure according to FIG. 6, taken on the line VII—VII in said Figure.

As beforementioned the use of rigid sections 2 enables the door leaf 1 to take up wind forces and other like forces acting at right angles on the door leaf. Consequently, as will be seen from the section view of FIG. 7, respective rigid panels, or sections, are guided in the side rails 9 by means of rollers 20 which form right angles with the panels of the door leaf.

Because a door of this construction will be somewhat heavier than the door structures aforedescribed, it will probably be necessary to provide the door with a crush guard. This door structure, however, also affords the important advantage of positive folding of the door leaf while using fully flexible intermediate door-leaf panels 14, preferably made of fabric material.

Another very important advantage afforded by all of the embodiments of the inventive door structure resides in the fact that only relatively small spaces are required on either side of the door structure and that the space required to accommodate a folded package of door-leaf panels 14 is also relatively small. This latter space will naturally depend on the number of panels making up the door leaf. If the desired height of the door opening is designated h, the space required to accommodate a folded door leaf when using side rails with two guide channels will be h/4, with three channels h/6, with four channels h/8, and so on.

We claim:

1. A vertically foldable door structure to cover a door opening comprising;

side guide means (6–8) arranged on the vertical sides of the door opening;

a door leaf (1) being divided into a plurality of horizontal, foldable panels (2, 14), each panel having an upper and lower long edges and vertical end portions, at least said end portions of each alternate ones of said panels (21) being rigid; and at least the remaining of said panels (14) comprising a flexible material;

guide means (15, 20) attached to said rigid end portions and co-acting guidingly with said side guide means; and wherein said side guide means comprises a plurality of pairs of side guides, each guide in said pair being correspondingly vertically oriented, and each pair of side guides being operative with respect to at least a corresponding one of said panels having a rigid end portion.

2. A door structure according to claim 1, wherein said door leaf (1) has an even number of panels (2, 14), of which the lowermost panel (2) has rigid end portions (3) and is guided in an associated pair of side guides (6) and the uppermost panel (14) is flexible and is attached along its upper long edge to the upper horizontal defining surface of the door opening; and wherein said structure further comprises means (40) for raising the door leaf (1), said means being attached to the rigid end portions (3) of the lower panel (2).

3. A door structure according to claim 1 or 2, characterized in that each panel (2) with rigid end portions (3) has at least the same width or breadth as the intermediate flexible panels (14) and each said panel is provided with two pairs of guide means (15; 20) for co-action with the pair of side guides (6–8) belonging to respective panels (2).

4. A door structure according to any of claims 1 or 2, wherein:

all said panels (2; 14) comprise flexible fabric material, said guide means (15) and side guides (6–8) being constructed so as to mutually co-act in taking up tension forces which may be applied against the plane of the door leaf (1).

5. A door structure according to claim 4, characterized in that said guide means comprises rollers (15) which are rotatable about axes extending perpendicularly to the plane of the fabric panels (2) and which co-act with vertical guide surfaces (16) of said side guides (6–8), said guide surfaces being located between the rollers (15) and the fabric panels (2).

6. A door structure according to any of claims 1 or 2, in which at least the upper and lower long edges and the vertical end portions of each alternate panel (2) is totally rigid and said guide means (20) and side guide means (6–8) are constructed so as to co-act to take-up forces, e.g., wind forces, which act at right angles to the door leaf (1).

7. A door structure according to claim 6, characterized in that the guide means include rollers (20) which rotate about axes that are parallel with the plane of the door leaf (1) and which co-act with vertical guide surfaces (21) on the side guides (6–8), said side guides being essentially of U-shape configuration, and said guide surfaces also extending parallel with the plane of the door leaf (1).

8. A door structure according to any of claims 1 or 2, characterized in that said side guides comprises channel-like rails (9) with a channel (6–8) for each side guide.

9. A door structure according to any of claims 1 or 2, characterized in that said flexible panels (2) comprise two pieces of fabric with an air layer (18) therebetween.

10. A door structure according to any of claims 1 or 2 characterized in that said door leaf (1) is operative to return to its door-closing position under the action of its own weight.

* * * * *